United States Patent [19]

Odgaard et al.

[11] Patent Number: 4,711,597

[45] Date of Patent: Dec. 8, 1987

[54] VANES FOR BANK PROTECTION AND SEDIMENT CONTROL IN RIVERS

[75] Inventors: A. Jacob Odgaard; John F. Kennedy, both fo Iowa City, Iowa

[73] Assignee: University of Iowa Research Foundation, Iowa City, Iowa

[21] Appl. No.: 886,871

[22] Filed: Jul. 18, 1986

[51] Int. Cl.[4] ..... E02B 3/04

[52] U.S. Cl. ..... 405/25; 405/21; 405/15; 405/74

[58] Field of Search ..... 405/15, 16, 21, 25; 244/198, 199, 35 R, 91; 415/192

[56] References Cited

U.S. PATENT DOCUMENTS

| | | | |
|---|---|---|---|
| 1,314,743 | 9/1919 | Groat | 405/25 |
| 2,498,262 | 2/1950 | Garbell | 244/35 R |
| 2,746,672 | 5/1956 | Doll, Jr. et al. | 415/192 |
| 3,167,922 | 2/1965 | Chabert et al. | 405/25 |
| 3,845,918 | 11/1974 | White, Jr. | 244/199 |
| 4,560,304 | 12/1985 | Jenkins et al. | 405/15 X |
| 4,661,013 | 4/1987 | Jenkins | 405/15 |

FOREIGN PATENT DOCUMENTS

| | | | |
|---|---|---|---|
| 20845 | 2/1980 | Japan | 405/21 |
| 201411 | 12/1982 | Japan | 405/16 |

*Primary Examiner*—Richard J. Scanlan, Jr.
*Assistant Examiner*—Anthony Knight
*Attorney, Agent, or Firm*—James C. Nemmers

[57] ABSTRACT

A flow-training structure for use in rivers and streams to minimize bank erosion, and to control bed degradation and aggradation. The structure consists of single vanes or arrays of vanes of a particular double-curved design. The vanes are installed in the river bed in designed arrays to produce changes in the local directions of the near-bed velocity, without changing the sediment-transport or flow-conveyance capacities of the channel.

5 Claims, 11 Drawing Figures

(VIEW A-A)

(VIEW C-C)

(VIEW B-B)

VANES FOR BANK PROTECTION AND SEDIMENT CONTROL IN RIVERS

BACKGROUND OF THE INVENTION

Straight alluvial rivers and streams are inherently unstable, and by their nature meander. The progressive growth of the meander bends erodes the banks along the outsides of the channel bends. The resulting heavy erosion is a consequence of the interaction between the vertical variation of the streamwise (downstream) velocity and the curvature of the channel and of the flow. The larger centrifugal force exerted on the near-surface fluid, which is moving faster than the near-bed fluid, drives the upper layers of water outward, toward the concave banks. At the same time, the slower moving, near-bed fluid is driven inward, toward the convex bank. The resulting spiraling, or secondary, flow moves toward the concave bank near the water surface, downward along the outer bank, and back along the bed toward the convex bank. The lateral motion of the near-bed fluid transports sediment from near the concave bank toward the convex bank until the bed becomes inclined such that the component of the submerged weight of the bed particles acting along the bed balances the transverse component of the shear stress exerted on the bed by the secondary flow. When bed equilibrium is achieved, the flow is much deeper, and the streamwise velocity is much larger, near the outside bank than near the inside bank. The resulting undermining of the outside bank and the intensive erosive attack produced by the higher velocity past it is responsible for the erosion of the outsides of river bends.

Bank erosion has become a major national problem, which causes irrevocable loss of millions of dollars worth of land each year, and produces sediment which is transported downstream to locations from which it must be dredged. The bank-protection methods in current general use include armoring of banks by one means or another ranging from paving with stone or concrete to enhanced vegetative cover. Another method that has been utilized involves installation of dikes or other structures to protect the banks and reduce the near-bank velocities. These methods are so expensive that in many cases they cannot be justified economically, and often are environmentally objectionable.

Recent analytical and experimental studies conducted at The University of Iowa have lead to a new concept for bank protection, and for control of riverbed degradation and aggradation. This concept involves use of specially designed vanes installed in particular arrays near the outside of the bend so as to divert the slower-moving bottom water toward the outer bank and thereby prevent undermining and high-velocity erosive attack on the outer bank. For aggradation and degradation control, the vanes are installed in rows, with particular orientations and in designed arrays, on either side of the channel thalweg. In both cases, the vanes modify or generate secondary currents which reduce bank erosion and/or alleviate channel degradation or aggradation, depending on the design of the vane array.

In the University of Iowa studies, a laboratory channel model, with some idealization, was constructed to simulate an actual bend in the Sacramento River in California of two river miles in length. FIG. 7 depicts the steady-state bed topography produced in the model, before vanes were installed, by a model discharge of 5.45 cfs which corresponds to a Sacramento River discharge of 87,000 cfs. In FIG. 7, the numbers of the contours represent depths in feet in the river, and the section numbers equal the distance in feet from the manifold along the inside flume wall.

FIG. 8 shows the transverse bed profiles measured at six model sections before vanes were installed. Then, the two-row array of vanes depicted in FIG. 9 was installed along the outer half of the bend. The model vanes were plane pieces of 28-gage galvanized steel which were held by the sand bed. The length of each vane in the model represented a vane 56 ft. in length in the river and was placed at an angle of incidence of approximately 15° to the channel centerline. At a discharge of 87,000 cfs the tops of the vanes were one third of the local, initial depth above the bed. The number of vanes installed for the first test were 52, and the cross sections measured in the model after a period of time that represented 1,500 hrs in the river and at discharge of 87,000 cfs are shown in FIG. 10.

A comparison of corresponding cross sections in FIGS. 8 and 10 demonstrates that the vanes are surprisingly effective in improving the uniformity of depth and depth-averaged velocity across the channel. Perhaps most importantly, the vanes obviated the point bar and the associated deep scour hole. The average transverse bed slope was reduced to less than 0.03 at all sections. Indeed, the lateral variations of depth shown in FIG. 10 are no greater than would occur in a straight alluvial channel of this width and mean depth. Along the reach occupied by the scour hole and point bar before the vanes were installed, which includes Sections 80, 88 and 96, the near-bank velocity and depth were reduced by approximately 25 percent. The effect of the vanes is even more impressive in view of the fact that the ratios of nearbank to centerline velocities in the channel without vanes undoubtedly was significantly higher in the model than they would be in the actual river, due to the smoothness of the flume wall. Before the vanes were installed, a significant fraction of the wetted perimeter was formed by the smooth, plywood flume wall, as can be seen in FIG. 9. Had the roughness of the flume wall been comparable to that of the sand bed, the initial transverse velocity gradient would have been smaller, and fewer vanes probably would have been required to accomplish the same result.

Immediately after installation of vanes some minor scouring was observed to occur around the upstream end of each. However, as the outer part of the bend aggraded, the localized scouring became negligible.

In view of the success enjoyed by the 52-van array, tests were also conducted with arrays composed of fewer vanes, ranging from 9–52. It was found that arrays composed of 36–52 vanes produced comparable transverse velocity distributions, provided the upstream part of the bend had a two-row array with a centerline space of 200 ft approximately, and the remainder of the bend was fitted with the outer-row array with about the same streamwise spacing.

However, the average transverse bed slopes increased slightly as the number of vanes was reduced. FIG. 11 shows the steady-state bed profiles produced by a 36-vane array consisting of the configuration shown in FIG. 9 upstream from Section 96, downstream from which the inner row shown in FIG. 9 was removed. It is seen in FIG. 11 that, as described above, the outer-bank velocities are about the same as those produced by the 52-vane array, shown in FIG. 10, while the reductions in the depths near the outer bank were slightly less. A few tests were also conducted to delineate the optimum angle of incidence. It was found that for values of greater than approximately 20°, flow separation occurred around a third or more of the vane length and produced a persistent scour hole near the upstream end of each vane. As the angle of the incidence was reduced, the number of vanes producing objectionable scouring also decreased. On the basis of the few tests conducted it was concluded that the optimum angle, for which the vanes are still effective in reducing the secondary current but do not produce scour which might endanger their stability, is between 10° and 17°.

The overall effect of the vane system on the river-flow pattern was judged to be minor. The 52-van array produced a minor, but not significant, change in the longitudinal slope of the water surface. The change was somewhat less in the case of the 36-vane array. The changes in the average depths and velocities across the channel were also judged to be insignificant.

The vanes proved to be surprisingly effective in nullifying the secondary currents produced in channel bends, which often lead to undermining and accelerated erosion of river banks. The attenuation of the secondary currents was dramatically demonstrated in experiments in which surface floats were placed on the flow near the upstream end of the curve. For the flow without vanes, the floats soon were transported to near the outer bank, while in the flows over vaned beds retained nearly their initial transverse distribution. It is believed that further reduction in the lateral nonuniformity of the depth-averaged velocity could be achieved by installing another row of vanes along a line about one-third of the channel width out from the inner bank after the outer rows had restored some degree of lateral depth uniformity. The two vane arrays tested did nothing to counter the centrifugally induced torque produced over this part of the channel, which must be significant for the depths and velocities produced near the inner bank in the flows over the vaned beds.

The foregoing concept and experiments are described in further detail by A. Jacob Odgaard and John F. Kennedy in an article entitled "River-Bend Bank Protection of Submerged Vanes" published in the *Journal of Hydraulic Engineering,* ASCE, Volume 109, No. 8, August 1983. Although straight vanes of the type described in this paper modify the secondary current in river bends so as to reduce bank erosion, and are an improvement over methods involving armoring of the concave outer banks of streams, the straight vanes tend to produce changes in the overall sediment-transport and flow-conveyance characteristics of the streams which are not desirable.

The present invention is an improved vane structure that minimizes outerbank erosion in river bends, and permits amelioration of river-bed degradation and aggradation, without causing objectionable changes in the sediment-transport and flow-conveyance capacities of streams.

SUMMARY OF THE INVENTION

The vane structure of the invention is a small, double-curved-surface vane rather than a straight structure. The double-curved design produce enhanced lateral force on the near-bed fluid, and thereby increases the torque on the flowing stream which cancels the secondary flow produced by the channel curvature. The vane also has a curved and rounded nose which minimizes downwash and local bed scour around the vane.

BRIEF DESCRIPTION OF THE DRAWINGS

FIGS. 7–11 illustrate results from prior art laboratory tests as more fully described in the background of the invention.

DESCRIPTION OF THE PREFERRED EMBODIMENT OF THE INVENTION

Figure 1:
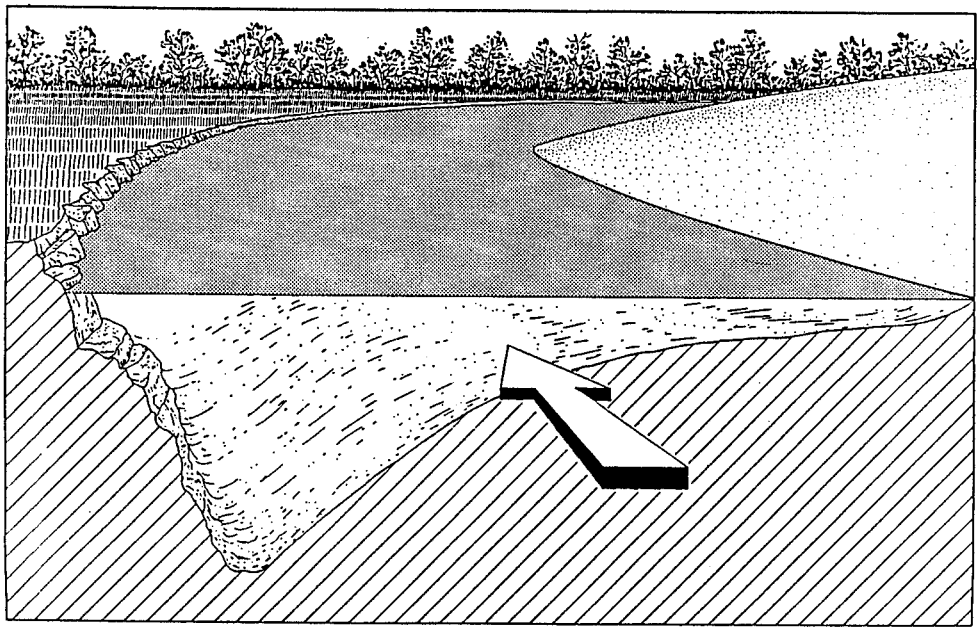
FIG. 1 is a perspective view, partly in section, of a representation of a typical river bend showing the effects of the currents and erosion on the river bed and banks.

It will be seen from the drawings that the cross section of the vane in horizontal planes has roughly the shape of a curved airfoil, with the blunter end being positioned upstream. In other words, as seen in FIG. 1 which is a view of a vane from above, the flow of water would be from right to left. The upper part of the leading edge 10 of the vane is rounded as at nose 14 that terminates tangentially with the edge 10. Edge 10 extends to a point of intersection 16 with bottom edge 20 which, when the vane is installed, rests in the river bed.

Figure 4:
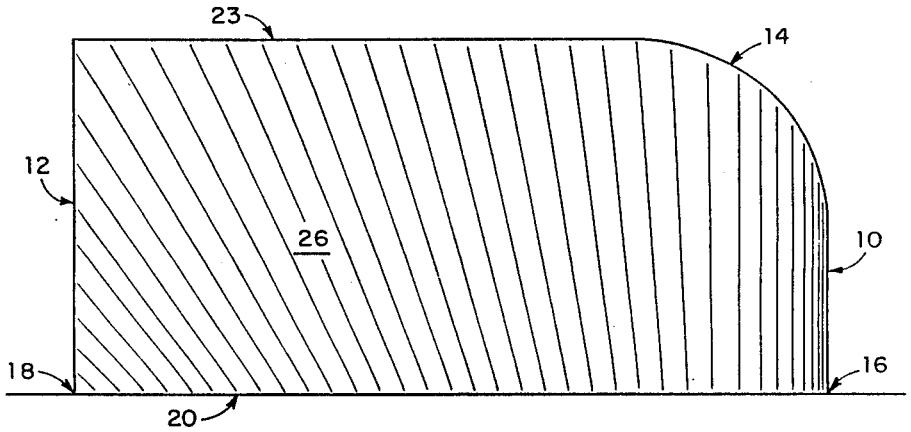
FIG. 4 is an elevational view of the vane, viewing FIG. 3 in the direction indicated by the arrows A—A.
Figure 6:
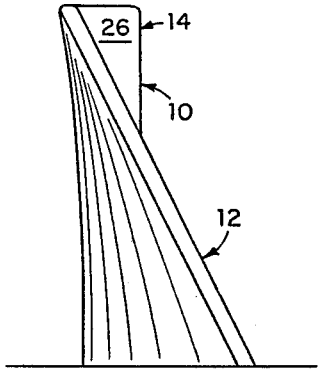
FIG. 6 is a rear end view, viewing FIG. 3 in the direction indicated by the arrows C—C.
Figure 5:
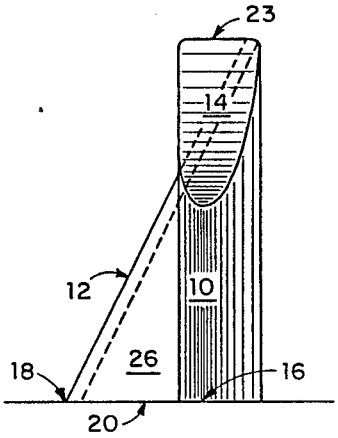
FIG. 5 is a front end view, viewing FIG. 3 in the direction indicated by the arrows B—B.
Figure 7:
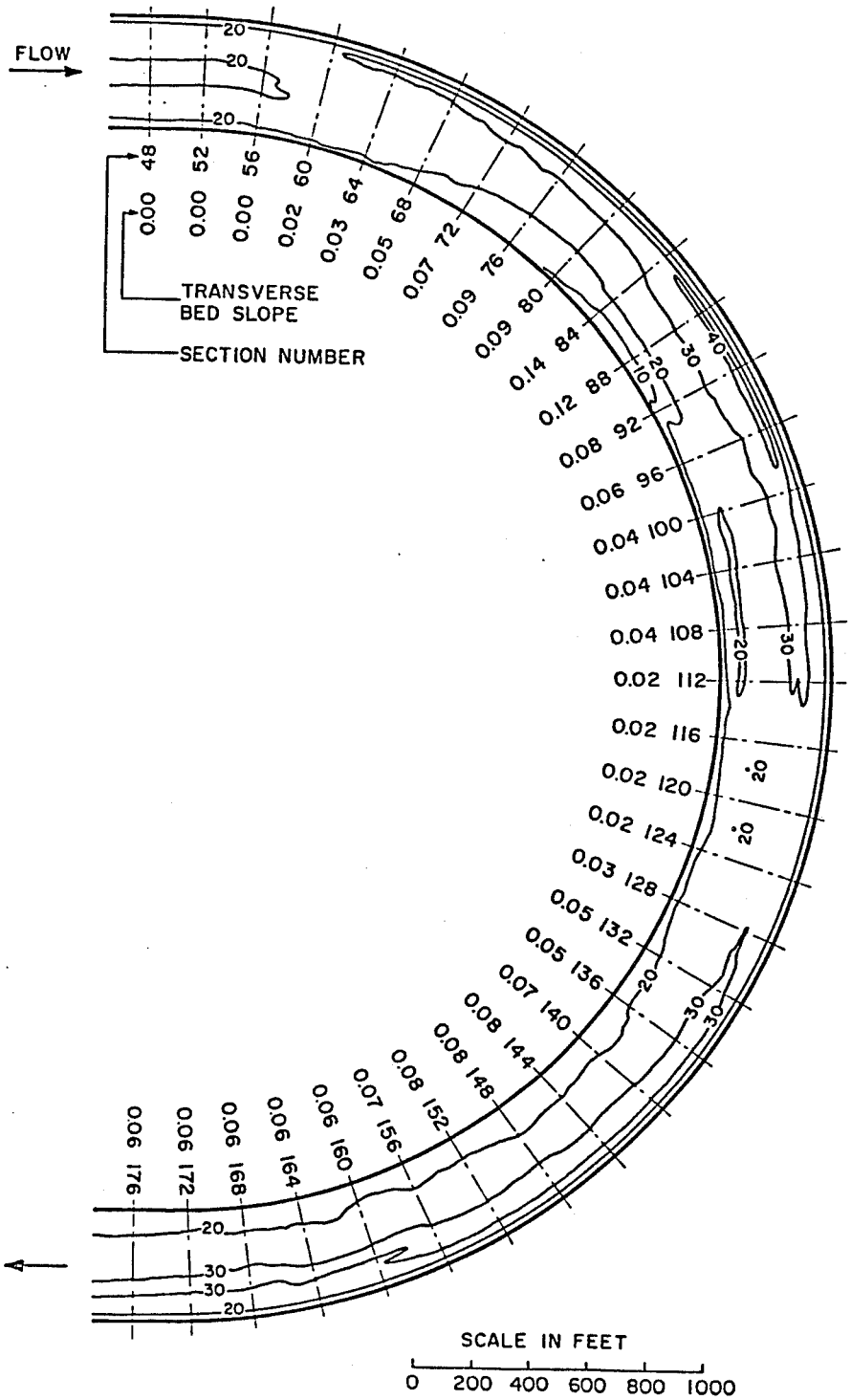
FIG. 7 depicts the topography produced in a laboratory model of a river, without any vanes installed.
Figure 8:
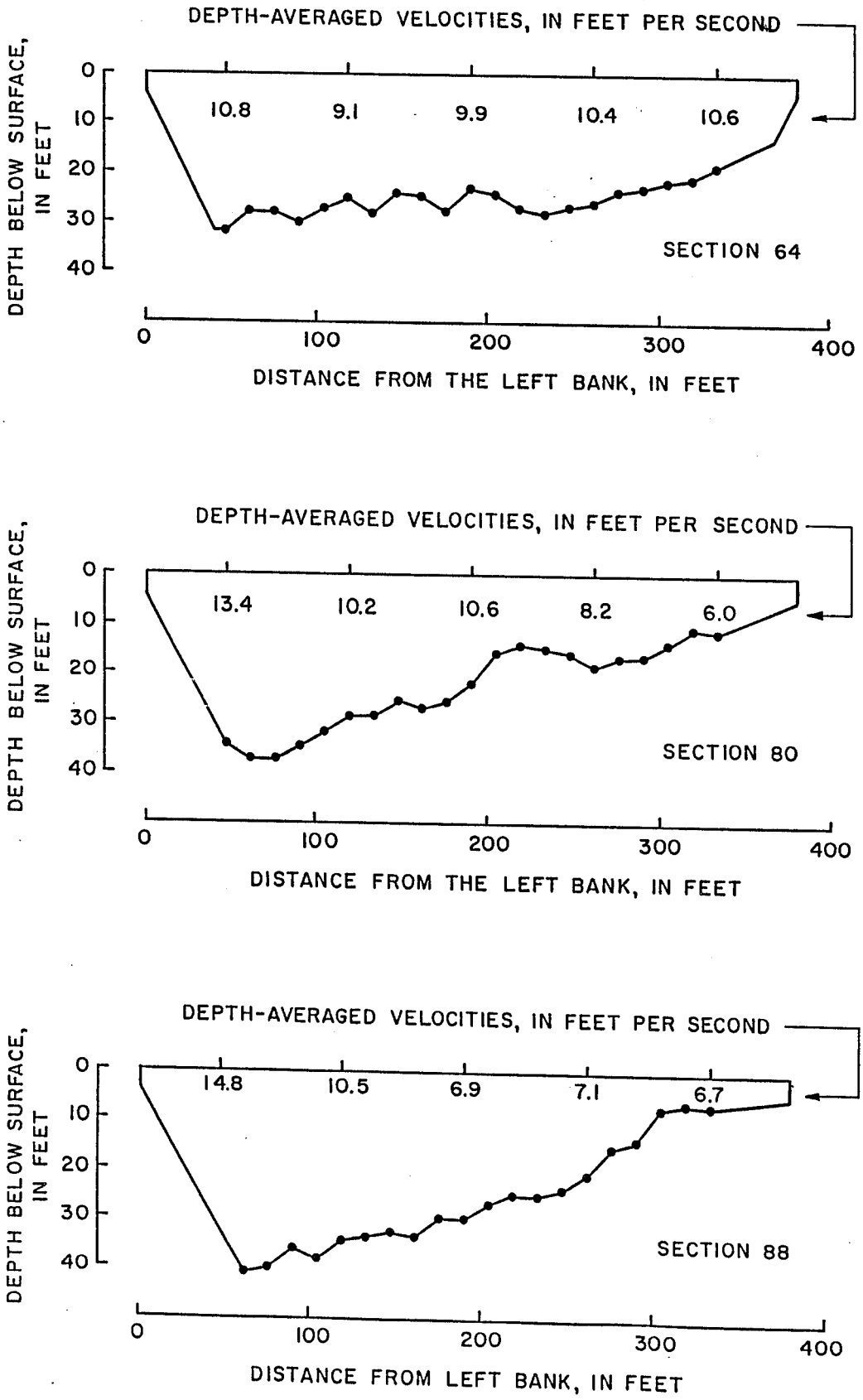
FIG. 8 shows transverse bed profiles of the laboratory model measured at six different locations.
Figure 9:
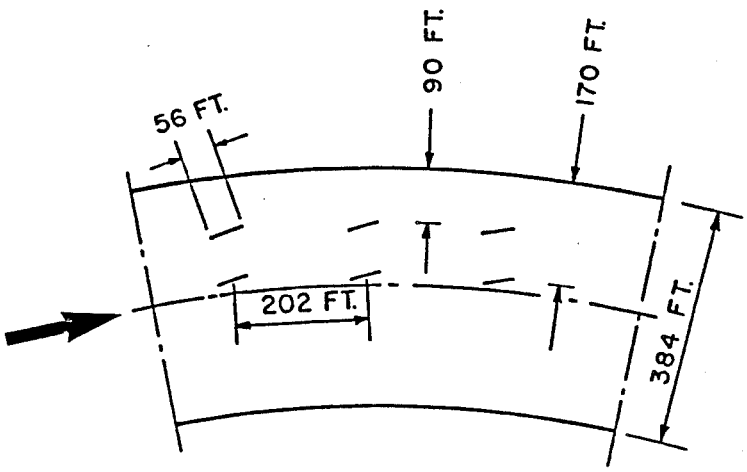
FIG. 9 illustrates the location of a two-row array of prior art straight vanes installed along the outer half of the bend of the model river.
Figure 10:
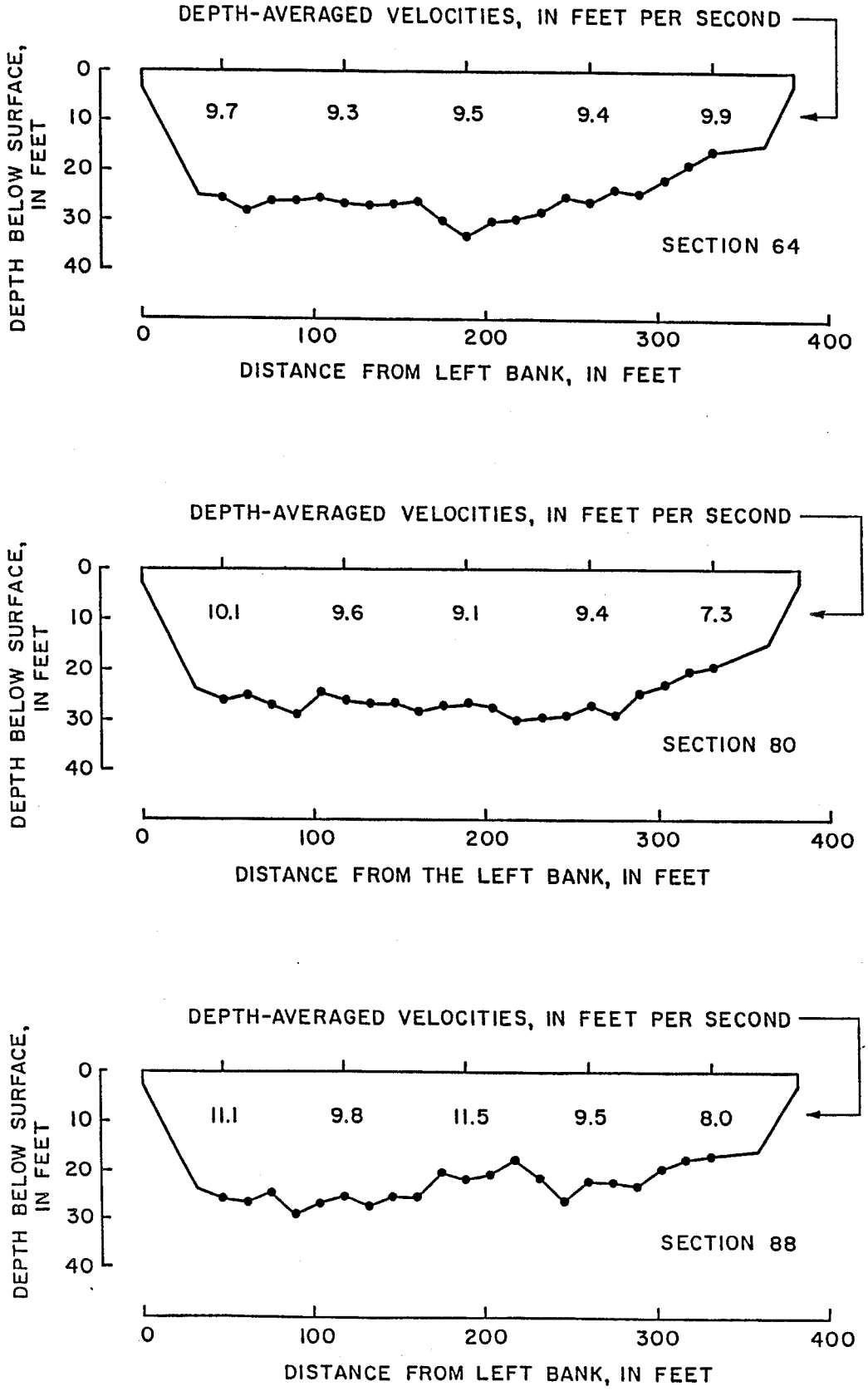
FIG. 10 shows transverse bed profiles of the laboratory model river measured at the same six sections shown in FIG. 8 after installation of straight vanes of the prior art.
Figure 11:
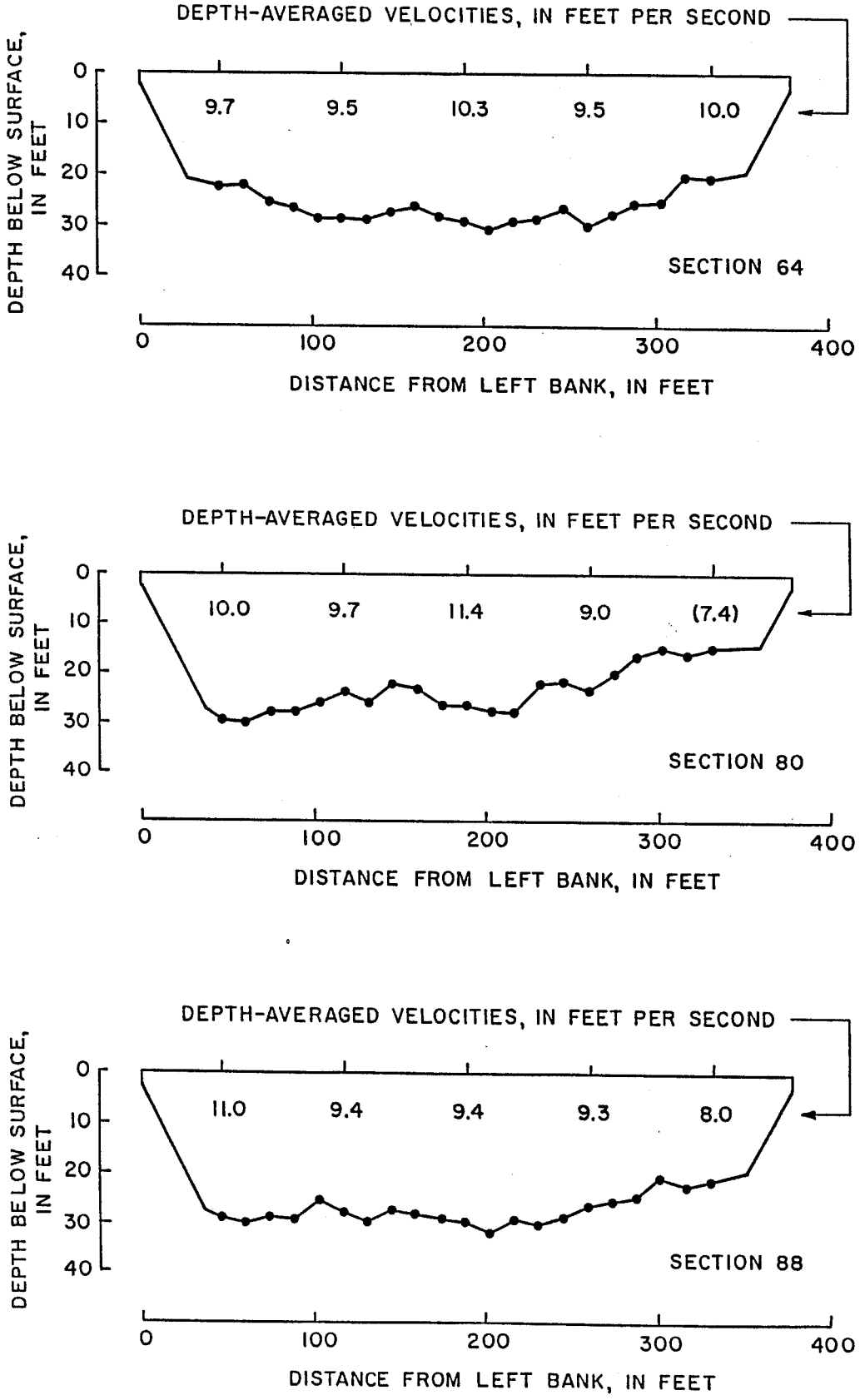
FIG. 11 shows the transverse bed profiles of the laboratory model river measured at the same six sections of FIGS. 8 and 10 using a 36-vane array.

The downstream end 12 of the vane is thinner than the leading edge 10, and is of substantially uniform thickness, as can best be seen in FIG. 4. However, the point of intersection 18 of the downstream end 12 of the vane with the bottom edge 20 is offset as the vane is viewed from front to rear. This offset is substantial, as can best be seen in FIG. 1. It will also be noted in Figure 1 that the left edge 22 of the top edge 23 of the vane is straight over much of the vane's length, while the right edge 24 is curved along the length of the vane, from the leading edge 10 to the downstream end 12. As best seen in FIG. 1, this provides a curved surface 26 on one side of the vane which produces a lateral force on the near-bottom flow in the river, and a concomitant torque on the river flow.

The shape of the nose 14 has been curved to minimize downwash and also to minimize scour around the leading edge of the vane 16.

Figure 2:
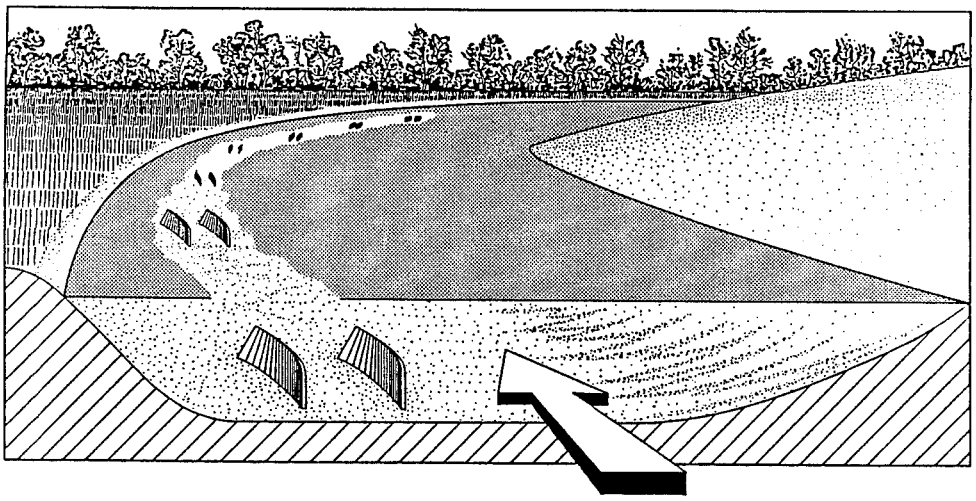
FIG. 2 is a view similar to FIG. 1 showing the vanes of the invention in place and the river bed and river bank improvement resulting therefrom.
Figure 3:
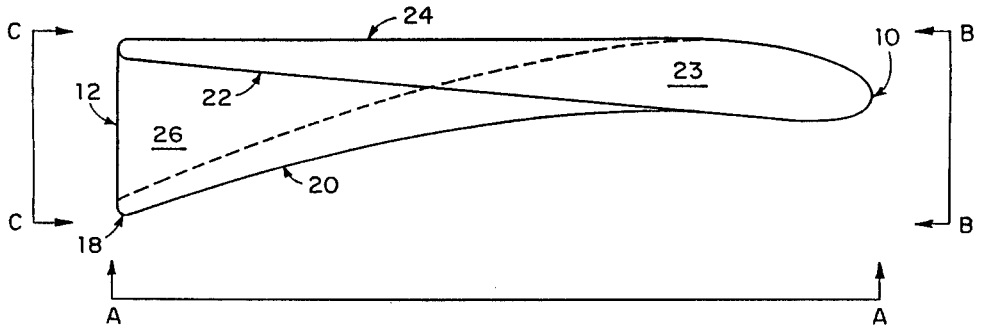
FIG. 3 is a top view of a single vane constructed according to the principles of the invention.

The vanes of the invention that have been described above are deployed along the river in the manner illustrated in FIG. 2 and are deployed at an angle to the oncoming flow in the range of 10° to 15°, as opposed to the somewhat greater angle of the prior-art vanes. We have found that this is sufficient to stabilize the flow and eliminate the curvature-induced secondary currents in river bends. Because of the small angle of attack, the vanes are not subjected to excessive force by the flow. The small angle of attack leads to the vanes being quite stable, free from local erosion, and not dependent upon their weight to hold them in place. The optimal height of the vanes is typically ¼ of the local water depth, and are inclined to have an angle of attack of 10° to 15° by the oncoming flow. The curved shape of the vanes produces the necessary effect in altering the flow of the bottom water and directing it toward the outer bank, thereby reducing the large depths and high velocities encountered there. As previously noted, the curved shape also eliminates local scour that occurred around prior-art vanes.

We have also found that by using vanes of the invention, the number of vanes necessary to produce the desired effect can be greatly reduced. Using vanes of the invention, we have found that a single vane will produce the desired result required by 7 or 8 vanes of the prior art. In addition, the ultimate results are greatly improved, since these vanes, due to their unique design, provide less drag and therefore produce less change in the overall flow-conveyance capacity of the channel. As previously noted, the sediment-transport characteristics of the flow are not altered by the vanes, as was the case with the prior-art-vane design.

Having thus described the invention in connection with a preferred embodiment of it, it will be evident to those skilled in the subject of river engineering that various revisions and modifications can be made to the preferred embodiment without departing from the spirit and scope of the invention. It is our intention, however, that all such revisions and modifications as are obvious to those skilled in river engineering and fluid mechanics, will be included within the scope of the following claims.

What is claimed is:

1. A flow-training structure for use in open-channel flow of rivers and streams comprising a vane having an upstream end and a downstream end, a top surface and a bottom surface connecting the upstream end and downstream end, a double-curved convex surface on one side between the top and bottom surfaces and upstream and downstream ends and a double-curved concave surface on the other side, the upstream end being vertical and the downstream end having its center line lying in a vertical plane and inclined to the vertical thus creating the double-curved surfaces on each side of the vane, said curved surfaces producing directional changes in the flow when the vane is positioned in a river or stream.

2. The flow-training structure of claim 1 in which the intersection of the upstream end and top surface is a curved surface forming a rounded nose at the upper portion of the upstream end.

3. The flow-training structure of claim 2 in which the cross-sectional shape of the vanes in planes parallel to the top surface is the shape of an air foil.

4. The flow-training structure of claim 3 in which the cross-sectional shape of the vane in planes parallel to the top surface is the shape of a cambered air foil in the planes closest to the bottom surface.

5. The flow-training structure of claim 4 in which the downstream end is of substantially uniform thickness.

* * * * *